US007703172B2

(12) United States Patent
Lee et al.

(10) Patent No.: US 7,703,172 B2
(45) **Date of Patent: *Apr. 27, 2010**

(54) COMPLEX TYPE CLEANER

(75) Inventors: Yong Woo Lee, Seoul (KR); Choon Myun Chung, Gyeonggi-Do (KR); Ho Seon Rew, Seoul (KR); Hyeun Sik Nam, Seoul (KR); Young Gyu Jung, Incheon (KR)

(73) Assignee: LG Electronics Inc., Seoul (KR)

( * ) Notice: Subject to any disclaimer, the term of this patent is extended or adjusted under 35 U.S.C. 154(b) by 1425 days.

This patent is subject to a terminal disclaimer.

(21) Appl. No.: 11/029,383

(22) Filed: Jan. 6, 2005

(65) Prior Publication Data

US 2006/0085942 A1 Apr. 27, 2006

(30) Foreign Application Priority Data

Oct. 27, 2004 (KR) ..... 10-2004-0086370

(51) Int. Cl.
*A47L 11/30* (2006.01)
*A47L 7/00* (2006.01)

(52) U.S. Cl. ..... 15/320; 15/353

(58) Field of Classification Search ..... 15/320–322, 15/328, 331, 353
See application file for complete search history.

(56) References Cited

U.S. PATENT DOCUMENTS 3,869,749 A * 3/1975 London et al. ..... 15/302
4,096,601 A * 6/1978 Knestele ..... 15/320
4,349,935 A * 9/1982 Knestele ..... 15/320
5,093,955 A * 3/1992 Blehert et al. ..... 15/320
5,263,224 A 11/1993 Lovelady
5,301,386 A * 4/1994 Thomas et al. ..... 15/321
5,634,238 A 6/1997 McCaffrey et al.
5,640,738 A * 6/1997 Williams et al. ..... 15/320
6,131,237 A * 10/2000 Kasper et al. ..... 15/320
6,167,586 B1 1/2001 Reed, Jr. et al.

(Continued)

FOREIGN PATENT DOCUMENTS

CN 2498978 7/2002

(Continued)

OTHER PUBLICATIONS

English Language Abstract of CN 2498978.

(Continued)

*Primary Examiner*—David B Thomas
(74) *Attorney, Agent, or Firm*—KED & Associates, LLP

(57) ABSTRACT

A cleaner includes: a body provided with a dust collecting container for storing dust; a fan motor installed at the body and generating a suction force; a vacuum cleaning head disposed at a lower side of the body, for sucking dust when vacuum cleaning; and a water cleaning head mounted at the vacuum cleaning head, and provided with a suction head through which contaminated water is sucked when water cleaning and a water collecting container for storing contaminated water sucked through the suction head. As a suction nozzle for sucking contaminated water and a water collecting container for storing the contaminated water sucked through the suction nozzle are integrally formed and installed at a suction head, a cleaner capable of reducing the number of parts and a production cost, and employing a small capacity fan motor is provided.

17 Claims, 7 Drawing Sheets

U.S. PATENT DOCUMENTS

| | | | | |
|---|---|---|---|---|
| 6,687,952 | B1 | 2/2004 | Mohan, Jr. | |
| 6,832,409 | B2 * | 12/2004 | Morgan et al. | 15/354 |
| 7,000,286 | B2 * | 2/2006 | Wang | 15/320 |
| 7,159,271 | B2 * | 1/2007 | Sepke et al. | 15/320 |
| 7,254,864 | B2 * | 8/2007 | Cipolla et al. | 15/320 |
| 7,322,071 | B2 * | 1/2008 | Lee et al. | 15/320 |
| 2003/0014829 | A1 | 1/2003 | Wang | |
| 2005/0198763 | A1 | 9/2005 | Lee et al. | |

FOREIGN PATENT DOCUMENTS

| | | |
|---|---|---|
| GB | 2286113 | 1/1994 |
| GB | 2411823 | 9/2005 |
| JP | 1-043218 | 2/1989 |

OTHER PUBLICATIONS

U.S. Appl. No. 11/029,382, filed Jan. 6, 2005.
U.S. Appl. No. 11/029,365, filed Jan. 6, 2005.
U.S. Appl. No. 10/720,113, filed Nov. 25, 2003.
U.S. Appl. No. 10/879,106, filed Jun. 30, 2004.
U.S. Appl. No. 11/028,236, filed Jan. 4, 2005.
English Language Abstract of JP 1-043218.

* cited by examiner

COMPLEX TYPE CLEANER

BACKGROUND OF THE INVENTION

1. Field of the Invention

The present invention relates to a complex type cleaner, and more particularly, to a complex type cleaner capable of selectively performing vacuum cleaning for sucking dust and foreign materials and water cleaning for cleaning a region to be cleaned by spraying cleaning water in one cleaner.

2. Description of the Background Art

Generally, an upright type vacuum cleaner includes: a body arranged in an upright state; a suction fan mounted in the body and generating a suction force; a filter container having a filter therein for collecting dust or filth sucked by the suction force generated from the suction fan; a suction head disposed at a lower side of the body, for sucking dust or filth on a floor; and a brush rotatably installed at the suction head, for sweeping up dust and filth on the floor.

In the upright type vacuum cleaner, when the suction fan is driven, a suction force is generated. Dust and foreign materials on a floor or a carpet are sucked through the suction head by the generated suction force. Then, the dust and foreign materials are filtered by the filter and collected in the filter container.

In addition, a general extractor includes: a water supply container containing cleaning liquid; a pump for pumping the cleaning liquid contained in the water supply container; a spray nozzle for spraying the cleaning liquid pumped by the pump onto a region to be cleaned; a suction nozzle for sucking contaminated water and dust on the region to be cleaned onto which the cleaning liquid is sprayed by the spray nozzle; a water collecting container for storing the contaminated water sucked through the suction nozzle; and a suction fan for generating a suction force so that the contaminated water can be sucked into the suction nozzle.

In the extractor, the pump is driven, the cleaning liquid stored in the water supply container is sprayed onto the carpet or the like through the spray nozzle, and the brush rotates to rub the carpet. Then, contaminated water is sucked through the suction nozzle and collected in the water collecting container. At this time, air is exhausted to the outside.

In the conventional cleaner, since a vacuum cleaner should be provided for vacuum cleaning of dust and filth, and an extractor should be provided for water cleaning of the carpet or the like, two cleaners are required, thereby increasing the cost. In addition, since much room is occupied in storing two cleaners, inconvenience is resulted from keeping the two cleaners.

SUMMARY OF THE INVENTION

Therefore, an object of the present invention is to provide a complex type cleaner capable of reducing the cost, improving convenience for use and facilitating the keeping by implementing both a vacuum cleaning function for sucking dust and a water cleaning function by spraying cleaning water onto a region to be cleaned in one cleaner.

Another object of the present invention is to provide a complex type cleaner capable of reducing the number of parts and a production cost, and employing a small capacity fan motor as a suction nozzle for sucking contaminated water and a water collecting container for storing the contaminated water sucked through the suction nozzle are integrally formed and installed at a suction head.

Still Another object of the present invention is to provide a complex type cleaner capable of minimizing contaminated water's backflowing into the floor after completing a cleaning job by minimizing a flow passage through which the contaminated water passes by integrally forming the suction nozzle for sucking the contaminated water and the storage container for storing the contaminated water.

To achieve these and other advantages and in accordance with the purpose of the present invention, as embodied and broadly described herein, there is provided a complex type cleaner of the present invention, comprising: a body provided with a dust collecting container for storing dust; a fan motor installed at the body and generating a suction force; a vacuum cleaning head disposed at a lower side of the body, for sucking dust at the time of performing vacuum cleaning; and a water cleaning head mounted at the vacuum cleaning head, and provided with a suction head through which contaminated water is sucked at the time of performing water cleaning and a water collecting container for storing contaminated water sucked through the suction head.

A dust suction opening through which dust is sucked is formed at a lower surface of the vacuum cleaning head, and a suction hose for guiding the dust sucked through the dust suction opening to the dust collecting container is connected to a rear side of the vacuum cleaning head.

The complex type cleaner further comprises a cleaning water spay unit including: a water tank mounted at the rear surface of the body, for storing cleaning water; a cleaning water supply line connected to the water tank, for supplying cleaning water onto the region to be cleaned; a pump installed at the cleaning water supply line, for pumping the cleaning water stored in the water tank; and a spray nozzle installed at the end of the cleaning water supply line, for spraying the cleaning water pumped by the pump onto the carpet.

The water collecting container is mounted at an upper surface of the vacuum cleaning head, and the suction nozzle is integrally formed with an upper surface of the water collecting container and communicates with the water collecting container.

A floater which closes up the air discharge opening by being raised by a buoyancy force so as to prevent water flowing into the water collecting container from being discharged through the air discharge opening is installed on the water collecting container.

The suction nozzle comprises: a nozzle portion disposed at a front of the dust suction opening, through which water is sucked; and a guide passage portion integrally formed with the nozzle portion and guiding contaminated water sucked through the nozzle portion to the inlet of the water collecting container.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, one embodiment of a complex type cleaner in accordance with the present invention will be described with reference to the accompanying drawings.

There can be a plurality of embodiments in accordance with the present invention, and, hereinafter, the most preferable embodiment will be described.

Figure 1:
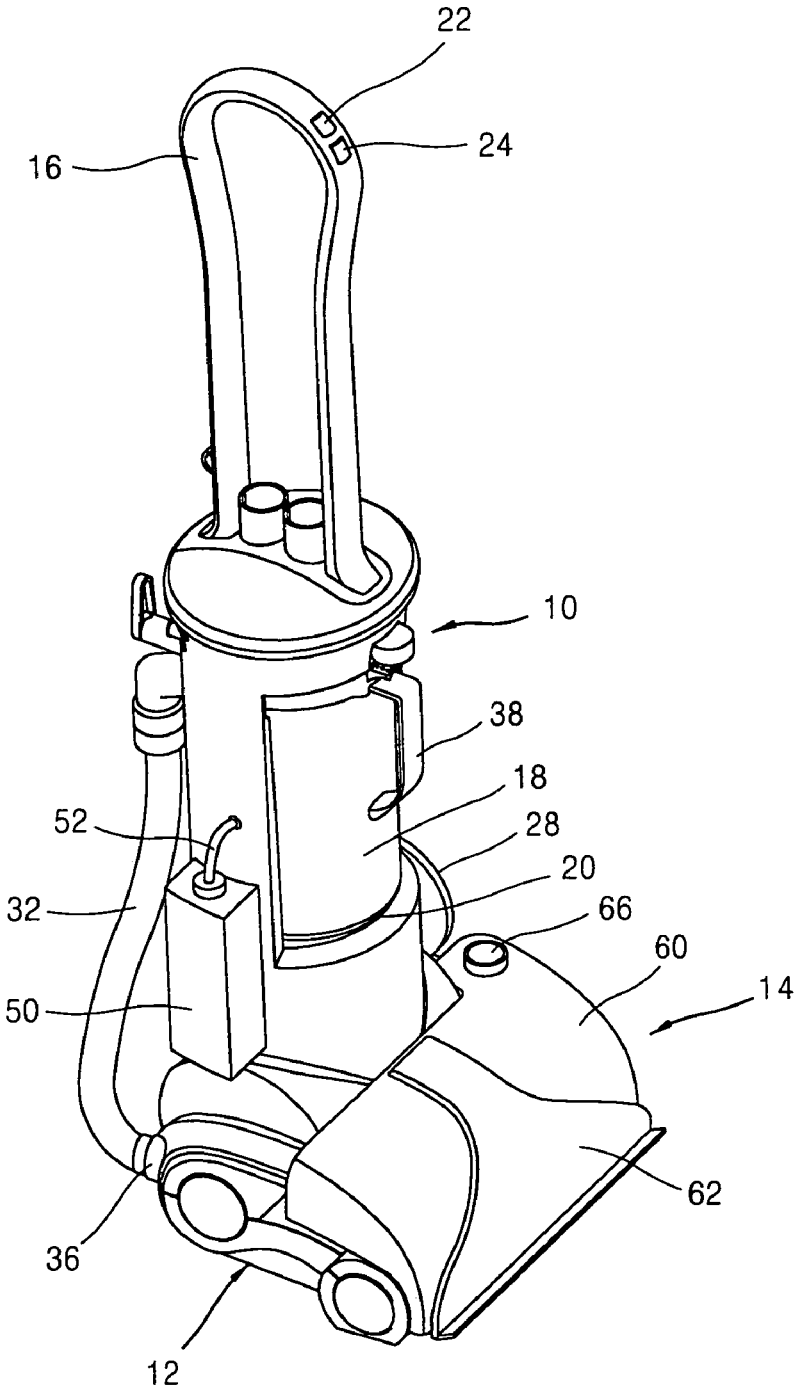
FIG. 1 is a perspective view showing a complex type cleaner in accordance with one embodiment of the present invention.
Figure 2:
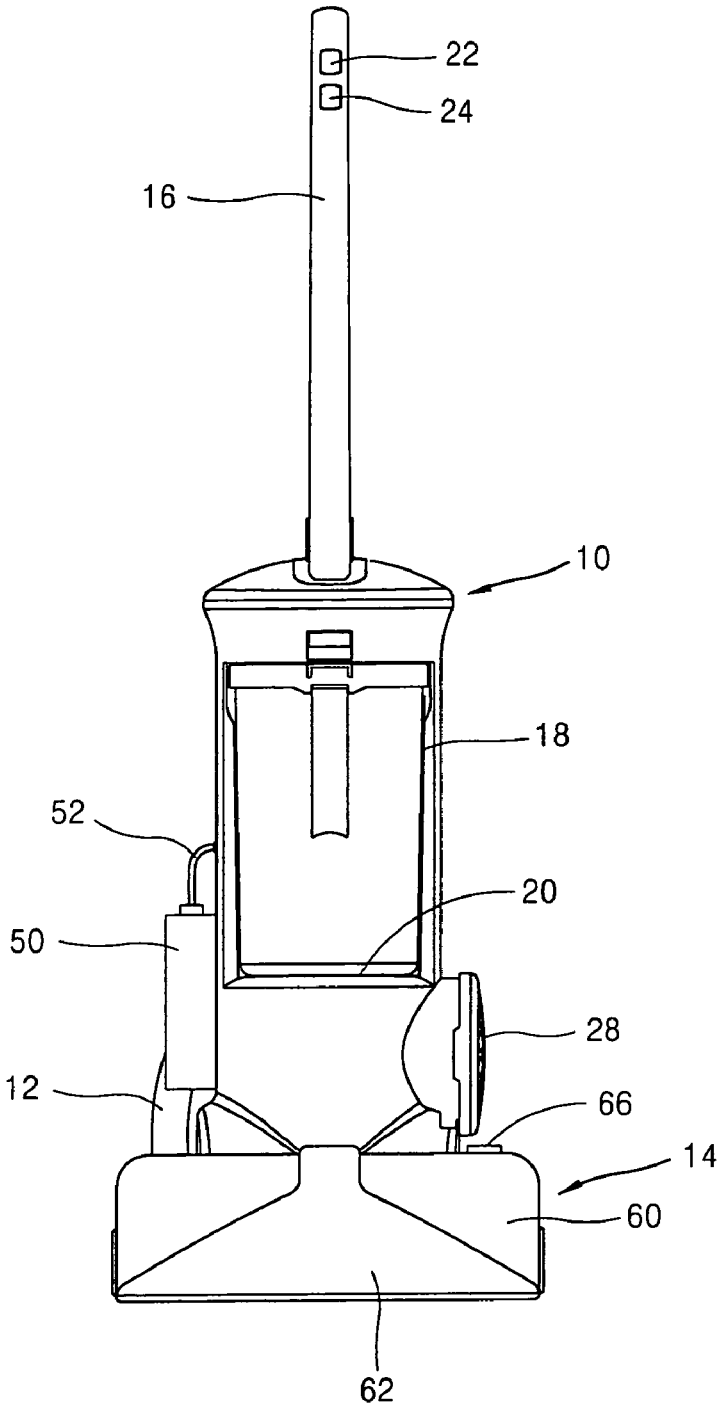
FIG. 2 is a side view showing the complex type cleaner in accordance with one embodiment of the present invention.
Figure 3:
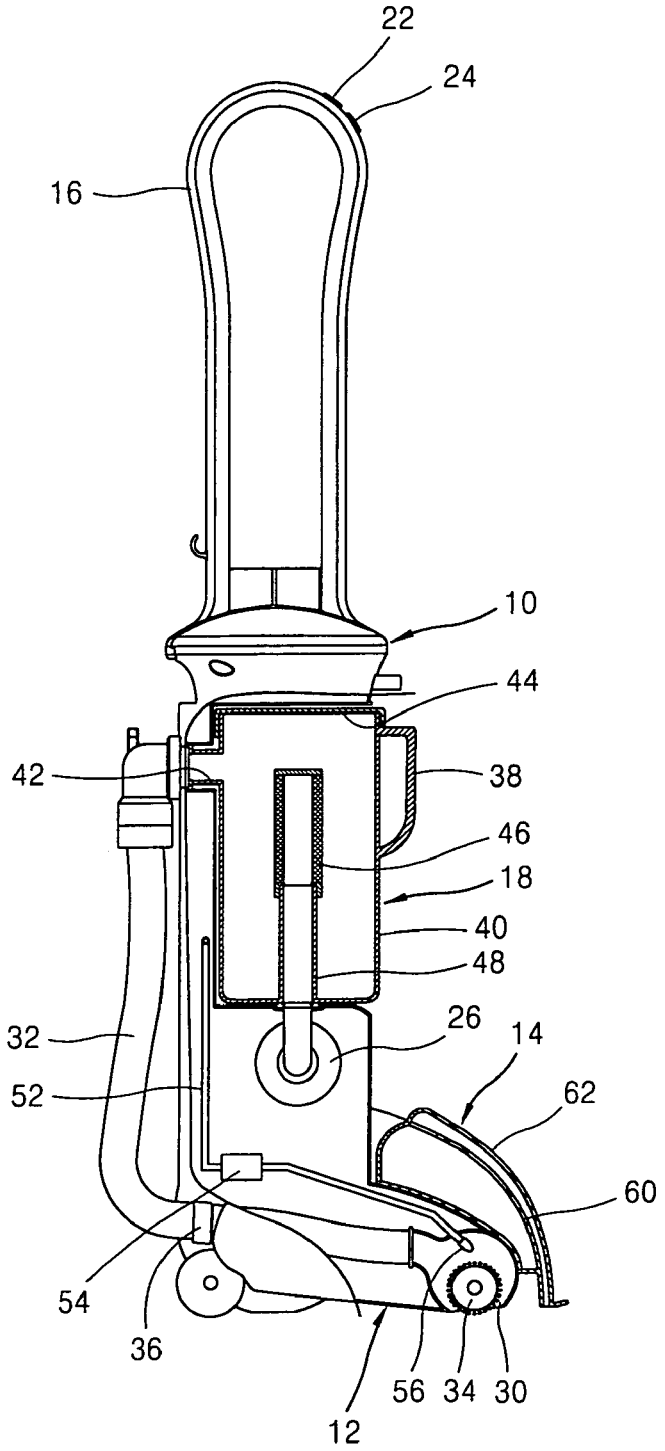
FIG. 3 is a cross-sectional view showing the complex type cleaner in accordance with one embodiment of the present invention.

FIG. 1 is a perspective view showing a complex type cleaner in accordance with one embodiment of the present invention, FIG. 2 is a side view showing the complex type cleaner in accordance with one embodiment of the present invention, and FIG. 3 is a cross-sectional view showing the complex type cleaner in accordance with one embodiment of the present invention.

The cleaner in accordance with one embodiment of the present invention includes: a body 10 arranged in an upright state; a vacuum cleaning head 12 disposed at a lower side of the body 10, for sucking dust at the time of performing vacuum cleaning; and a water cleaning head 14 installed at the vacuum cleaning head 12, the water cleaning head 14 into which water contaminated after completing a cleaning job is sucked and in which the sucked contaminated water is stored, at the time of water cleaning.

The body 10 is provided with a handgrip 16 at an upper side thereof, and a container mounting portion 20 for mounting a dust collecting container 18 for collecting dust is formed at a front side of the body 10.

A vacuum cleaning switch 22 adjusted by a user in case of the vacuum cleaning mode for sucking dust and a water cleaning switch 24 adjusted by a user in case of the water cleaning mode are installed on the handgrip 16.

In addition, a fan motor 26 connected to the dust collecting container 18, for generating suction force is mounted at a lower side of the container mounting portion 20, and an outlet 28 for exhausting clean air filtered while passing through the dust collecting container 18 to the outside is formed at one side of the fan motor 26.

Moreover, a cleaning water spray unit for spraying cleaning water onto the carpet or the floor in case the cleaner performs a water cleaning function is installed at the body 10.

The cleaning water spray unit includes: a water tank 50 mounted at the rear surface of the body 10, for storing cleaning water; a cleaning water supply line 52 connected to the water tank 50, for supplying cleaning water onto the region to be cleaned; a pump 54 installed at the cleaning water supply line 52, for pumping the cleaning water stored in the water tank 50; and a spray nozzle 56 installed at the end of the cleaning water supply line 52, for spraying the cleaning water pumped by the pump 54 onto the carpet.

The vacuum cleaning head 12 is mounted at a lower portion of the body 10, a dust suction opening 30 for sucking dust and foreign materials is formed at a lower surface of the vacuum cleaning head 12. A suction hose 32 for guiding the dust sucked through the dust suction opening 30 to the dust collecting container 18 is connected to a rear side of the vacuum cleaning head 12.

In addition, a brush 34 is rotatably mounted at a lower portion of the vacuum cleaning head 12, and the brush sweeps up dust and foreign materials on a floor and a carpet toward the inside of the air suction opening 30 at the time of a vacuum cleaning mode, and rubs the region to be cleaned onto which cleaning water is sprayed at the time of a water cleaning mode.

The dust collecting container 18 includes: a container 40 mounted at the container mounting portion 20 formed at the body 10, having a space for collecting dust, and having a handgrip 38 at one side thereof; a cover 44 openably mounted at an upper surface of the container 40; an inlet 42 formed at one side of the container 40 and connected to the suction hose 32 for sucking dust and foreign materials into the container 40; a filter 46 arranged in the container 40, for filtering dust and foreign materials having been sucked into the container 40; and an exhaust passage 48 formed at a lower side of the container 40, connected to the filter 46 for exhausting air purified while passing through the filter 46, and connected to the fan motor 26.

Figure 4:
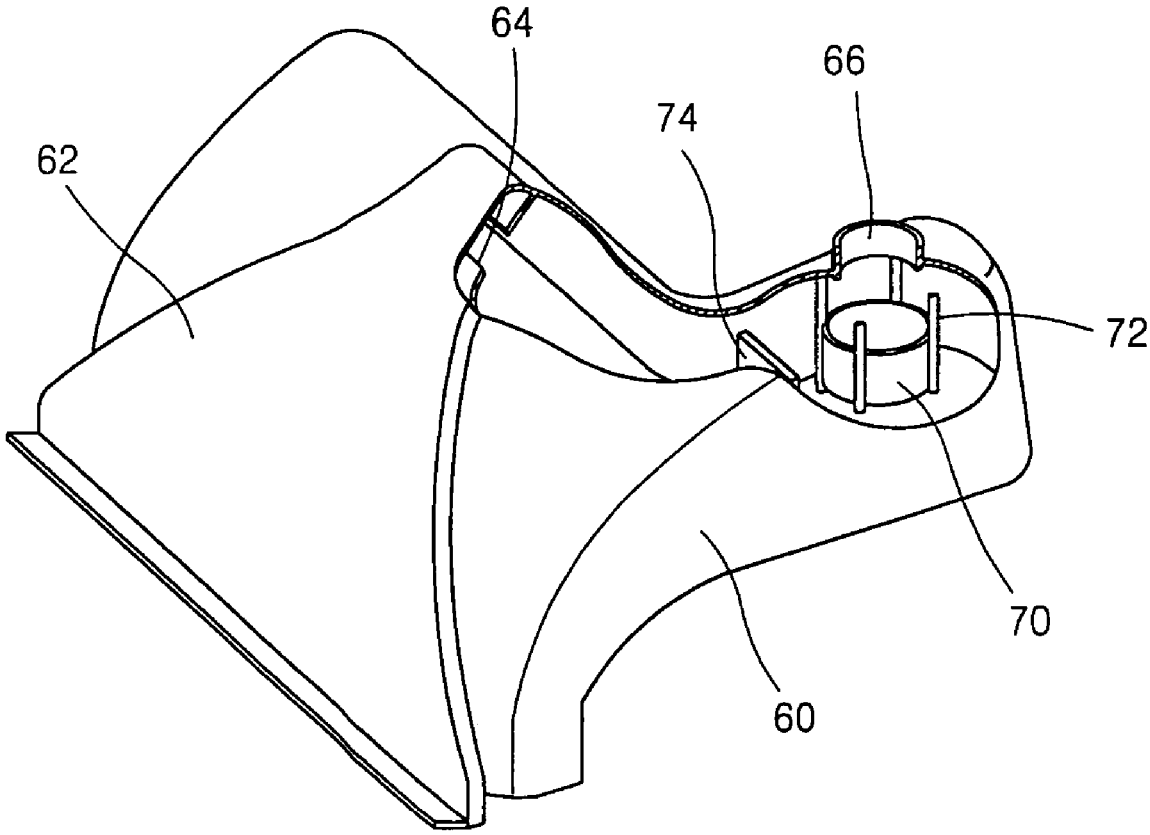
FIG. 4 is a perspective view showing a water collecting container in accordance with the present invention.
Figure 5:
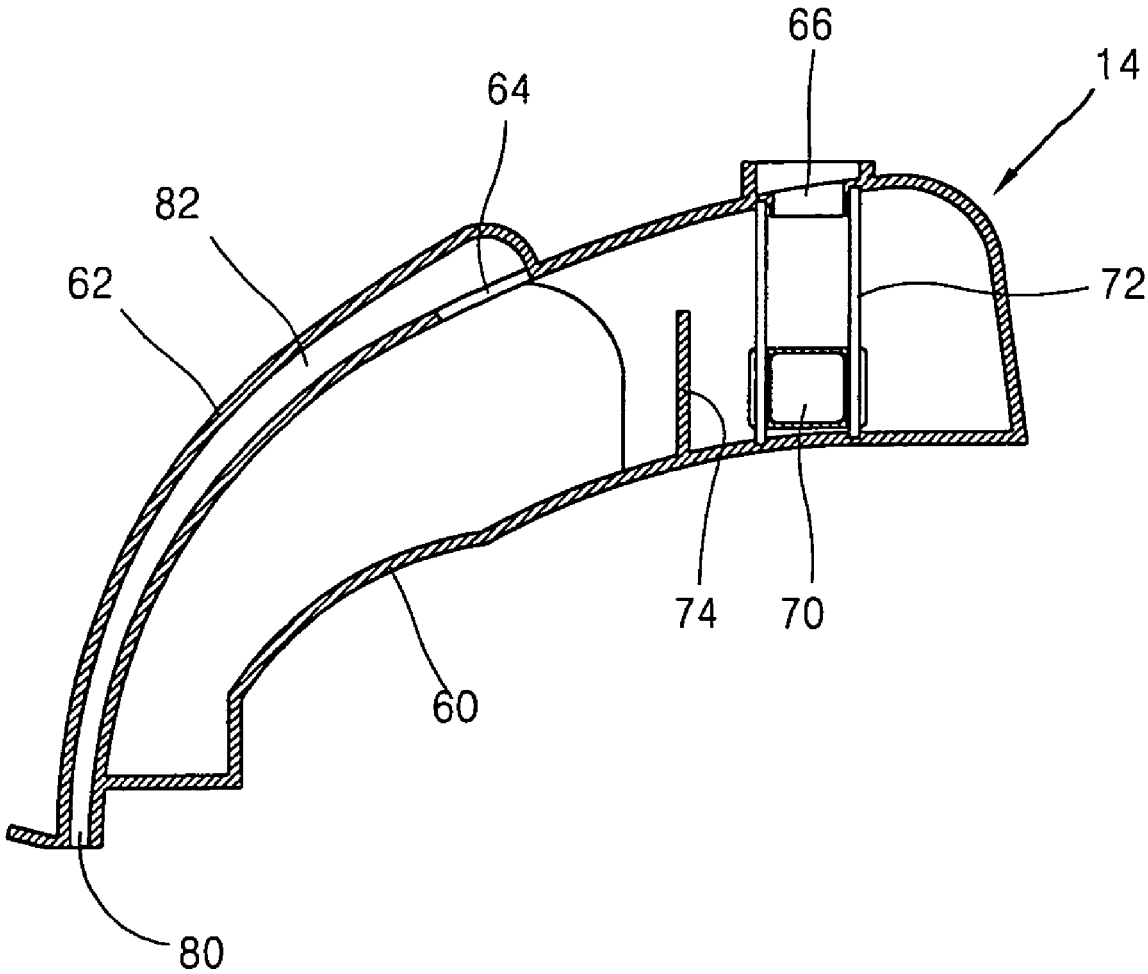
FIG. 5 is a cross-sectional view showing the water collecting container in accordance with the present invention.

FIG. 4 is a perspective view showing the water cleaning head in accordance with the present invention, and FIG. 5 is a cross-sectional view showing the water cleaning head in accordance with the present invention.

The water cleaning head 14 includes: a water collecting container 60 mounted at an upper surface of the vacuum cleaning head 12, for storing water contaminated after completing water cleaning; and a suction nozzle 62 installed at an upper surface of the water collecting container 60, for sucking the water contaminated after completing water cleaning.

The water collecting container 60 disposed at an upper surface of the vacuum cleaning head 12 and having a space for storing contaminated water. In addition, a suction opening 64 communicating with the suction nozzle 62, into which the contaminated water flows, and an air discharge opening 66 for discharging air inside the water collecting container 60 when the contaminated water is sucked through the suction opening 64 are formed at an upper surface of the water collecting container 60.

Herein, as the air discharge opening 66 is connected to the suction hose 32, air having been discharged through the air discharge opening 66 flows into the dust collecting container 18 through the suction hose 32, and the air having flowed into the dust collecting container 18 passes through the fan motor 26 and then is discharged to the outside through the outlet 28.

A floater 70 for preventing water having flowing into the water collecting container 60 from being discharged through the air discharge opening 66 is installed inside the water collecting container 60.

The floater 70 is vertically movably disposed to a floater housing 72 formed inside the water collecting container 60 and floats up by a buoyancy force when water becomes full to thereby close up the air discharge opening 66.

In addition, a blocking plate 74 for preventing water introduced through the suction opening 64 from being spattered towards the air discharge opening 66 and contaminated water stored in the water collecting container 60 from flowing into the air discharge opening 66 until the contaminated water reaches a certain level is formed between the suction opening 64 in the water collecting container 60 and the air discharge opening 66.

The suction nozzle 62 includes: a nozzle portion 80 provided with an entrance having a narrow width in order to easily suck water on the floor; and a guide passage portion 82 integrally formed with the nozzle portion 80 and communicating with the suction opening 64 of the water collecting container 60 such that contaminated water having been sucked into the nozzle portion 80 can be guided to the suction opening 64 of the water collecting container 60.

An operation of the complex type cleaner in accordance with the present invention will be described as follows.

Figure 6:
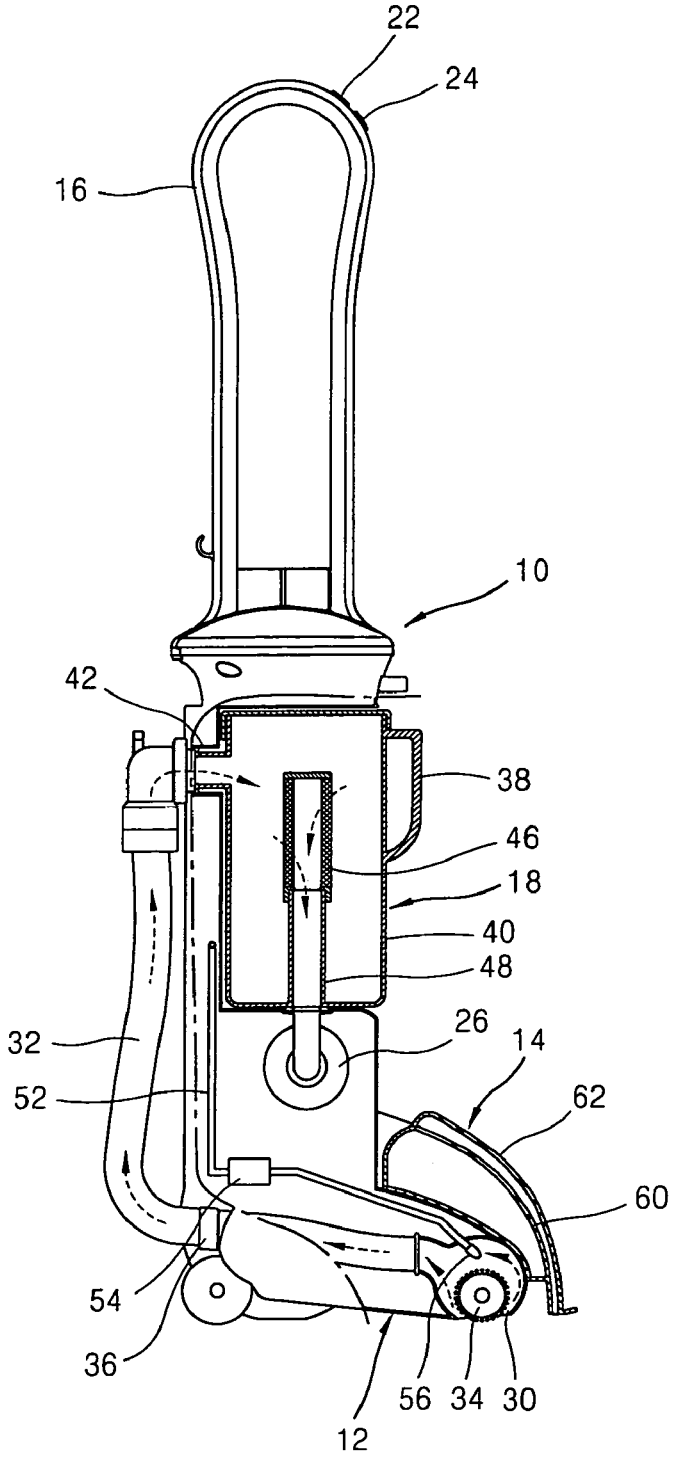
FIGS. 6 and 7 are views showing an operation of the complex type cleaner in accordance with one embodiment of the present invention.

FIG. 6 is a view showing an operation when the complex type cleaner in accordance with the present invention is used in a vacuum cleaning mode.

Firstly, when the cleaner is used in the vacuum cleaning mode, the user mounts the dust collecting container 18 at the container mounting portion 20 of the body 10, connects the suction hose 32 to a hose connection portion 36 of the vacuum cleaning head 12, and then operates the vacuum cleaning switch 22.

Then, the fan motor 26 is driven to generate a suction force, and therefore dust and foreign materials on the floor or the carpet are sucked into the vacuum cleaning head 12 through the dust suction opening 30. At this time, the brush 34 mounted at the suction opening 30 is rotated to sweep up the dust and the foreign materials on the floor or the carpet towards the inside of the vacuum cleaning head 12. The dust and the foreign materials having been sucked through the vacuum cleaning head 12 flow into the container 40 of the dust collecting container 18 through the suction hose 32. Then, the dust and the foreign materials having been sucked into the container 40 are filtered by the filter 46 and collected in the container 40. At this time, only air purified while passing through the filter 46 is exhausted through the exhaust passage 48, passes through the fan motor 26 and then is discharged to the outside through the outlet 28.

Figure 7:
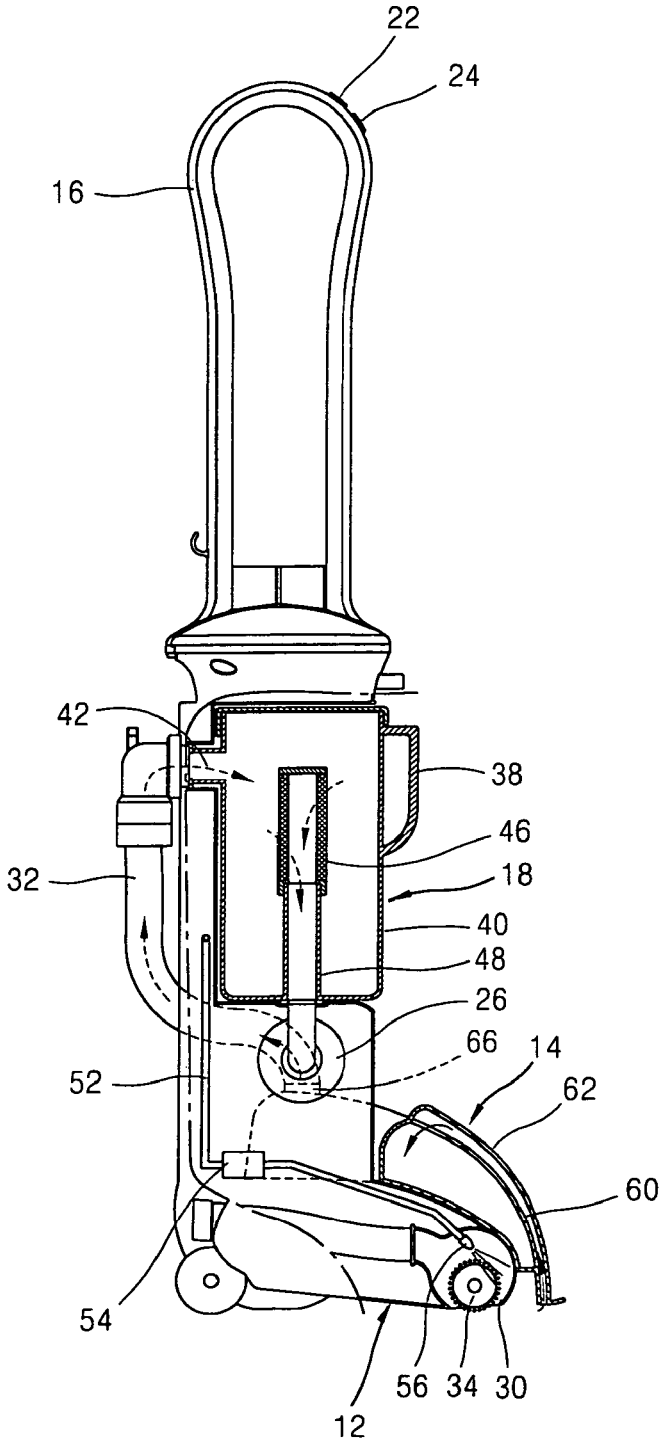

FIG. 7 is a view showing an operation when the complex type cleaner in accordance with the present invention is used in a water cleaning mode.

In addition, when the cleaner is used in the water cleaning mode, the user connects the suction hose 32 to the air discharge opening 66 formed at the water cleaning head 14. Then, the user operates the water cleaning switch 24 mounted to the body 10.

Then, the fan motor 26 is driven to generate a suction force, and at the same time the pump 54 is driven, thereby spraying cleaning water onto the floor or the carpet.

The cleaning water stored in the water tank 50 is guided to the spray nozzle 56 through the cleaning water supply line 52 by a pumping force generated by driving the pump 54, and the cleaning water is sprayed onto the floor or the carpet from the spray nozzle 56.

And, the brush 34 mounted within the vacuum cleaning head 12 is rotated and rubs the region to be cleaned or the carpet onto which the cleaning water is sprayed, thereby performing a washing job, and water contaminated after completing the cleaning is sucked into the nozzle portion 80 of the suction nozzle 62 by the suction force generated by driving the fan motor 26.

The contaminated water having been sucked into the nozzle portion 80 of the suction nozzle 62 is guided by the guide passage portion 82 and flows into the water collecting container 60 through the suction opening 64. At this time, air inside the water collecting container 60 is discharged through the air discharge opening 66 into the suction hose 32, and the air having been discharged through the suction hose 32 flows into the dust collecting container 18, passes through the fan motor 26 and then is discharged to the outside.

At this time, water is prevented from being discharged through the air discharge opening 66 by the floater 70 mounted within the water collecting container 60. That is, when water flowing into the water collecting container 60 is filled to a certain level by the blocking plate 74 and then the water flowing into the water collecting container 60 exceeds a certain level, the water goes over the blocking plate 74 and flows into the air discharge opening 66. Then, the floater 70 floats up by a buoyancy force and so closes up the air discharge opening 66, thereby preventing water from being discharged through the air discharge opening 66.

Effects of the complex type cleaner in accordance with the present invention will be described as follows.

By installing a water cleaning head which performs water cleaning at a vacuum cleaning head for sucking dust, dust and foreign materials are sucked through the vacuum cleaning head at the time of a vacuum cleaning mode, and at the time of a water cleaning mode, water contaminated after completing a cleaning job is sucked through a suction nozzle and is stored in the water collecting container. Accordingly, one cleaner can selectively perform vacuum cleaning and water cleaning, thereby reducing the cost, enhancing the user's convenience and facilitating storage of the cleaner.

In addition, as a suction nozzle for sucking contaminated water and a water collecting container for storing the contaminated water sucked through the suction nozzle are integrally formed and installed at a suction head, the number of parts and a production cost can be reduced, and a small capacity fan motor can be employed.

In addition, by minimizing a flow passage through which the contaminated water passes by integrally forming the suction nozzle for sucking the contaminated water and the water collecting container for storing the contaminated water, the contaminated water's backflowing onto the floor after completing a cleaning job can be minimized.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cleaner, comprising:

a body provided with a dust collecting container for storing dust;

a fan motor installed at the body and generating a suction force;

a vacuum cleaning head disposed at a lower side of the body, wherein the vacuum cleaning head sucks in dust in a vacuum cleaning mode;

a wet cleaning head mounted at the vacuum cleaning head, wherein the wet cleaning head includes:

a wet suction head that sucks in contaminated fluid in a wet cleaning mode; and a fluid collecting container that receives and stores contaminated fluid sucked in through the wet suction head, wherein the fluid collecting container is mounted at an upper surface of the vacuum cleaning head, and the wet suction head is integrally formed with an upper surface of the fluid collecting container so as to communicate with an interior of the fluid collecting container; and a brush installed in the vacuum cleaning head, wherein the brush sweeps up dust from a region to be cleaned during the vacuum cleaning mode and rubs the region to be cleaned in the wet cleaning mode.

2. The cleaner of claim 1, further comprising:

a dust suction opening provided at a lower surface of the vacuum cleaning head, wherein dust is sucked into the vacuum cleaning head through the dust suction opening; and a suction hose connected to the vacuum cleaning head to as to guide the dust sucked in through the dust suction opening to the dust collecting container.

3. The cleaner of claim 2 wherein the wet suction head comprises:

a nozzle portion disposed at a front of the dust suction opening, wherein contaminated fluid is sucked in through the nozzle portion; and a guide passage portion in communication with the nozzle portion wherein the guide passage portion guides contaminated fluid sucked in through the nozzle portion to an inlet of the fluid collecting container.

4. The cleaner of claim 3, wherein an inlet into the nozzle portion is configured so as to easily suck fluid from a surface of the region to be cleaned.

5. The cleaner of claim 1, further comprising:

a cleaning fluid spray unit that sprays cleaning fluid onto the region to be cleaned in the wet cleaning mode.

6. The cleaner of claim 5, wherein the cleaning fluid spray unit comprises:

a tank mounted at a rear side of the body, wherein the tank receives and stores uncontaminated cleaning fluid for use in the wet cleaning mode;

a supply line connected to the tank so as to supply uncontaminated cleaning fluid to the region to be cleaned;

a pump installed at the supply line so as to pump uncontaminated cleaning fluid from the tank; and a spray nozzle installed at an end of the supply line so as to spray uncontaminated cleaning fluid pumped by the pump onto the region to be cleaned.

7. The cleaner of claim 1, further comprising:

a wet suction opening in communication with the wet suction head such that contaminated fluid flows into the wet suction head through the wet suction opening; and an air discharge opening provided at an upper surface of the fluid collecting container, wherein air inside the fluid collecting container is discharged through the air discharge opening when contaminated fluid is sucked in through the wet suction opening.

8. The cleaner of claim 7, wherein the air discharge opening is connected to the fan motor and a suction hose connected between the vacuum cleaning head and the dust collecting container.

9. The cleaner of claim 7, further comprising a float; provided in the fluid collecting container, wherein the float is raised by a buoyant force of contaminated fluid in the fluid collecting container and closes the air discharge opening so as to prevent contaminated fluid flowing into the fluid collecting container; from being discharged through the air discharge opening.

10. The cleaner of claim 7, further comprising a blocking plate provided in the fluid collecting container, wherein the blocking plate prevents contaminated fluid flowing into the fluid collecting container from flowing into the air discharge opening until the contaminated fluid reaches a predetermined level in the fluid collecting container.

11. The cleaner of claim 1, further comprising a filter provided within the dust collecting container.

12. The cleaner of claim 1, wherein dust is deposited into the dust collecting container by the vacuum cleaning head in the vacuum cleaning mode, and air, sucked in by the wet suction head together with contaminated fluid, flows into the dust collecting container and is discharged in the wet cleaning mode.

13. The cleaner of claim 1, wherein the fan motor is configured to draw air into the dust collecting container in both the vacuum cleaning mode and the wet cleaning mode.

14. The cleaner of claim 1, further comprising a suction hose, wherein one end of the suction hose is selectively connectable to the vacuum head in the vacuum cleaning mode and to an air discharge opening of the wet cleaning head in the wet cleaning mode.

15. The cleaner of claim 1, wherein the fluid collecting container is positioned between the vacuum cleaning head and the wet suction head.

16. The cleaner of claim 1, wherein the wet cleaning head includes a tank that receives and stores uncontaminated cleaning fluid, wherein the tank is independent from the fluid collecting container that receives and stores contaminated fluid.

17. The cleaner of claim 1, wherein the wet cleaning head; includes a spray device provided adjacent to the wet suction head, wherein the spray device sprays cleaning fluid onto a surface of the region to be cleaned.

* * * * *